US008781822B2

(12) United States Patent
Majumdar et al.

(10) Patent No.: US 8,781,822 B2
(45) Date of Patent: Jul. 15, 2014

(54) AUDIO AND SPEECH PROCESSING WITH OPTIMAL BIT-ALLOCATION FOR CONSTANT BIT RATE APPLICATIONS

(75) Inventors: Somdeb Majumdar, San Diego, CA (US); Amin Fazeldehkordi, San Diego, CA (US); Harinath Garudadri, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 454 days.

(21) Appl. No.: 12/698,534

(22) Filed: Feb. 2, 2010

(65) Prior Publication Data

US 2011/0153315 A1 Jun. 23, 2011

Related U.S. Application Data

(60) Provisional application No. 61/289,287, filed on Dec. 22, 2009.

(51) Int. Cl.

| | |
|---|---|
| ***G10L 19/12*** | (2013.01) |
| ***G10L 21/00*** | (2013.01) |
| ***G10L 19/00*** | (2013.01) |
| ***G10L 19/002*** | (2013.01) |
| *G10L 19/02* | (2013.01) |
| *G10L 19/035* | (2013.01) |

(52) U.S. Cl.

CPC ..... *G10L 19/002* (2013.01); *G10L 19/0212* (2013.01); *G10L 19/035* (2013.01)

USPC ..... 704/222; 704/230; 704/221

(58) Field of Classification Search

USPC ..... 704/201–230

See application file for complete search history.

(56) References Cited

U.S. PATENT DOCUMENTS

| | | | | |
|---|---|---|---|---|
| 5,394,473 | A * | 2/1995 | Davidson | 704/200.1 |
| 5,414,796 | A * | 5/1995 | Jacobs et al. | 704/221 |
| 5,596,676 | A * | 1/1997 | Swaminathan et al. | 704/208 |
| 5,819,224 | A * | 10/1998 | Xydeas | 704/266 |
| 5,884,010 | A * | 3/1999 | Chen et al. | 704/228 |
| 6,006,179 | A * | 12/1999 | Wu et al. | 704/222 |
| 8,103,015 | B2 * | 1/2012 | Meyer et al. | 381/74 |
| 2001/0023395 | A1 * | 9/2001 | Su et al. | 704/220 |

(Continued)

FOREIGN PATENT DOCUMENTS

| | | |
|---|---|---|
| CN | 1151638 A | 6/1997 |
| CN | 1247415 A | 3/2000 |

(Continued)

OTHER PUBLICATIONS

Zanartu, Matias, 'Project Report: Audio Compression using Wavelet Techniques', Perdue University Electrical and Computer Engineering ECE 648, Spring 2005.*

(Continued)

*Primary Examiner* — Jesse Pullias

(74) *Attorney, Agent, or Firm* — Paul S. Holdaway

(57) ABSTRACT

Methods and apparatus for audio and speech processing including generating a plurality of frames, each of the frames comprising a plurality of transform coefficients, and allocating bits to the transform coefficients in each of the frames such that at least two of the transform coefficients in the same frame have different bit allocations and the total number of the bits allocated to the transform coefficients in at least two of the frames is equal.

35 Claims, 7 Drawing Sheets

(56) References Cited

U.S. PATENT DOCUMENTS

| | | | | |
|---|---|---|---|---|
| 2002/0007273 | A1* | 1/2002 | Chen | 704/229 |
| 2003/0185247 | A1* | 10/2003 | Chen et al. | 370/521 |
| 2005/0013197 | A1* | 1/2005 | Chung et al. | 368/10 |
| 2006/0149538 | A1* | 7/2006 | Lee et al. | 704/219 |

FOREIGN PATENT DOCUMENTS

| | | | |
|---|---|---|---|
| CN | 101030379 | A | 9/2007 |
| CN | 101308661 | A | 11/2008 |
| JP | H09288498 | A | 11/1997 |
| JP | 2000206990 | A | 7/2000 |

OTHER PUBLICATIONS

Kuldip K. Paliwal et al. "Efficient Vector Quantization of LPC Parameters at 24 Bits/Frame". IEEE Transactions on Speech and Audio Processing, vol. 1., No. 1, Jan. 1993.*

Brandenburg K, et al., "ISO-MPEG-1 Audio: A Generic Standard for Coding of High-Quality Digital Audio", Journal of the Audio Engineering Society, Audio Engineering Society, New York, NY, US, vol. 42, No. 10. Oct. 1, 1994, pp. 780-792. XP000978167, ISSN: 1549-4950.

International Search Report and Written Opinion—PCT/US2010/061751, International Search Authority—European Patent Office—Mar. 25, 2011.

Pedro De A Berger, et al., "Compression of EMG signals with wavelet transform and artificial neural networks; Compression of EMG signals", Physiological Measurement, Institute of Physics Publishing, Bristol, GB, vol. 27, No. 6, Jun. 1, 2006, pp. 457-465, XP020105778. ISSN: 0967-3334, DOI: DOI:10.1088/0967-3334/27/6/003.

Final text for DIS 11172-3 (rev. 2): Information Technology—Coding of Moving Pictures and Associated Audio for Digital Storage Media—Part 1—Coding at up to about 1.5 Mbit/s (ISO/IEC JTC 1/SC 29/WG 11 N 0156) [MPEG 92]—Section 3: Audio ED—International Standards Organization, Jan. 1, 1992, Coded Representation of Audio, Picture Multimedia and Hypermedia Information (Tentative Title), Apr. 20, 1992, ISO/IEC JTC 1/SC 29 N 147.

Noll P., "MPEG standards section 2 digital audio coding standards", Digital Consumer Electronics Handbook, Jan. 1, 1997, pp. 8.25-8.49,I/II.

Berger P., et al., "A new wavelet-based algorithm for compression of Emg Signals", Proceedings of the 29th Annual International Conference of the IEEE EMBS, 2007, pp. 1554-1557.

* cited by examiner

AUDIO AND SPEECH PROCESSING WITH OPTIMAL BIT-ALLOCATION FOR CONSTANT BIT RATE APPLICATIONS

CROSS REFERENCE TO RELATED APPLICATIONS

The present application for patent claims priority to Provisional Application No. 61/289,287 entitled "AUDIO AND SPEECH PROCESSING WITH OPTIMAL BIT-ALLOCATION FOR CONSTANT BIT RATE APPLICATION" filed Dec. 22, 2009, and assigned to the assignee hereof and hereby expressly incorporated by reference herein.

BACKGROUND

1. Field

The present disclosure relates generally to communications, and more particularly, to techniques for processing audio and speech signals.

2. Introduction

In the world of communications, where bandwidth is a fundamental limitation, audio and speech processing plays an important role multimedia applications. Audio and speech processing often involves various forms of signal compression to drastically decrease the amount of information required to represent audio and speech signals, and thereby reduce the transmission bandwidth. These processing systems are often referred to as encoders for compressing the audio and speech and decoders for decompressing audio and speech.

Traditional audio and speech processing systems achieve significant compression ratios using complex psychoacoustic models and filters at the cost of high complexity and delay. However, in the context of body area networks, tight constraints on power and latency demand simpler, low-complexity solutions to signal compression. Compression ratios are often traded off for power and latency gains.

SUMMARY

In one aspect of the disclosure, a method of audio or speech processing includes generating a plurality of frames, each of the frames comprising a plurality of transform coefficients, and allocating bits to the transform coefficients in each of the frames such that at least two of the transform coefficients in the same frame have different bit allocations and the total number of the bits allocated to the transform coefficients in at least two of the frames is equal.

In another aspect of the disclosure, an apparatus for audio or speech processing includes a processing system configured to generate a plurality of frames, each of the frames comprising a plurality of transform coefficients, and allocate bits to the transform coefficients in each of the frames such that at least two of the transform coefficients in the same frame have different bit allocations and the total number of the bits allocated to the transform coefficients in at least two of the frames is equal.

In yet another aspect of the disclosure, an apparatus for audio or speech processing includes means for generating a plurality of frames, each of the frames comprising a plurality of transform coefficients, and means for allocating bits to the transform coefficients in each of the frames such that at least two of the transform coefficients in the same frame have different bit allocations and the total number of the bits allocated to the transform coefficients in at least two of the frames is equal.

In a further aspect of the disclosure, a computer-program product for processing audio or speech includes computer-readable medium encoded with codes executable by one or more processors to generate a plurality of frames, each of the frames comprising a plurality of transform coefficients, and allocate bits to the transform coefficients in each of the frames such that at least two of the transform coefficients in the same frame have different bit allocations and the total number of the bits allocated to the transform coefficients in at least two of the frames is equal.

In yet a further aspect of the disclosure, a headset includes a transducer, a processing system configured to generate a plurality of frames from audio or speech output from the transducer, each of the frames comprising a plurality of transform coefficients, and allocate bits to the transform coefficients in each of the frames such that at least two of the transform coefficients in the same frame have different bit allocations and the total number of the bits allocated to the transform coefficients in at least two of the frames is equal, and a transmitter configured to transmit the frames.

In another aspect of the disclosure, a watch includes a user interface, processing system configured to generate a plurality of frames from audio or speech output from the user interface, each of the frames comprising a plurality of transform coefficients, and allocate bits to the transform coefficients in each of the frames such that at least two of the transform coefficients in the same frame have different bit allocations and the total number of the bits allocated to the transform coefficients in at least two of the frames is equal, and a transmitter configured to transmit the frames.

In yet another aspect of the disclosure, a sensing apparatus includes a sensor, a processing system configured to generate a plurality of frames from audio or speech output from the sensor, each of the frames comprising a plurality of transform coefficients, and allocate bits to the transform coefficients in each of the frames such that at least two of the transform coefficients in the same frame have different bit allocations and the total number of the bits allocated to the transform coefficients in at least two of the frames is equal, and a transmitter configured to transmit the frames.

DETAILED DESCRIPTION

Figure 1:
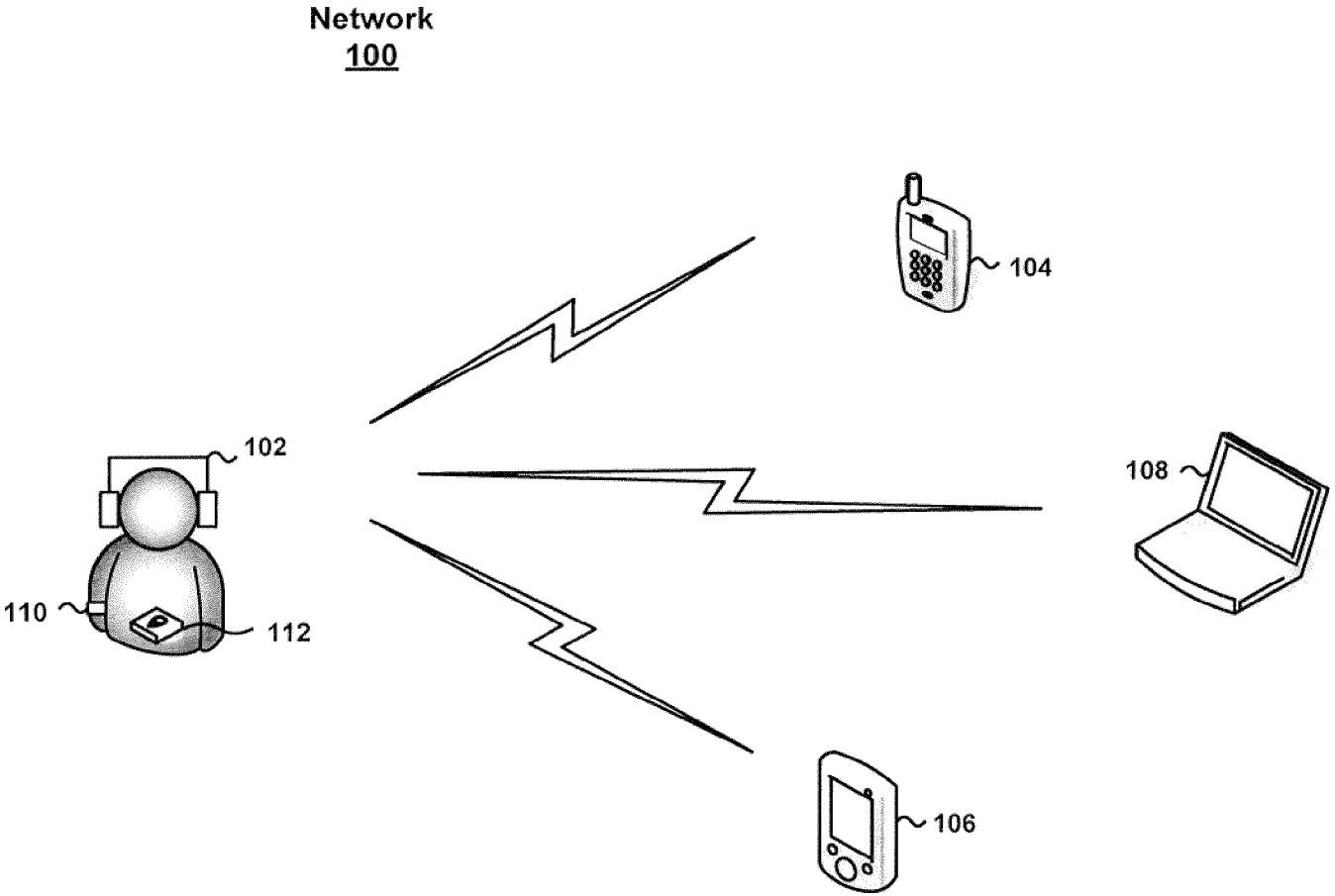
FIG. 1 is a conceptual diagram illustrating an example of a wireless communications network.

Various aspects of methods and apparatus are described more fully hereinafter with reference to the accompanying drawings. These methods and apparatus may, however, be embodied in many different forms and should not be construed as limited to any specific structure or function presented in this disclosure. Rather, these aspects are provided so that this disclosure will be thorough and complete, and will fully convey the scope of these methods and apparatus to those skilled in the art. Based on the teachings herein, one skilled in the art should appreciate that that the scope of the disclosure is intended to cover any aspect of the methods and apparatus disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the aspects presented throughout this disclosure herein. It should be understood that any aspect of the disclosure herein may be embodied by one or more elements of a claim.

Several aspects of audio and speech processing will now be presented. These aspects will be presented with reference to a transmitting and receiving apparatus in a wireless communications network. The transmitting apparatus includes an encoder for compressing audio or speech for transmission over a wireless medium. The receiving apparatus includes a decoder for expanding the audio or speech received over the wireless medium from the transmitting apparatus. In many applications, the transmitting apparatus may be part of an apparatus that receives as well as transmits. Such an apparatus would therefore require a decoder, which may be a separate processing system or integrated with the encoder into a single processing system known as a "codec." Similarly, the receiving apparatus may be part of an apparatus that transmits as well as receives. Such an apparatus would therefore require an encoder, which may be a separate processing system or integrated with the decoder into a codec. As those skilled in the art will readily appreciate, the various concepts described throughout this disclosure are applicable to any suitable encoding or decoding function, regardless of whether such function is implemented in a stand-alone processing system, integrated into a codec, or distributed across multiple entities in a wireless apparatus or a wireless communications network.

The various audio and speech processing techniques presented throughout this disclosure are well suited for integration into various wireless apparatus including a headset, a phone (e.g., cellular phone), a personal digital assistant (PDA), an entertainment device (e.g., a music or video device), a microphone, a medical sensing device (e.g., a biometric sensor, a heart rate monitor, a pedometer, an EKG device, a smart bandage, etc.), a user I/O device (e.g., a watch, a remote control, a light switch, a keyboard, a mouse, etc.), a medical monitor that may receive data from the medical sensing device, an environment sensing device (e.g., a tire pressure monitor), a computer, a point-of-sale device, an entertainment device, a hearing aid, a set-top box, or any other device that processes audio or speech signals. The wireless apparatus may include other functions in addition to the audio or speech processing. By way of example, a headset, watch, or sensor may include various audio or speech transducers (e.g., microphone and speakers) for user interaction with the apparatus.

An example of a wireless communications network that may benefit from the various concepts presented throughout this disclosure is illustrated in FIG. 1. In this example, a headset 102 worn by a user is shown in communication with various wireless apparatus including a cellular phone 104, a digital audio player 106 (e.g., MP3 player), and a computer 108. At any given time, the headset 102 may be transmitting or receiving audio or speech to or from one or more of these apparatus. By way of example, audio may be received by the headset 102 in the form of an audio file that is stored in memory of the digital audio player 106 or the computer 108. Alternatively, or in addition to, the headset 102 may also receive streamed audio from the computer 108 through a connection to a remote network (e.g., the Internet). The headset 102 may also support speech communications with the cellular phone 104 during a call over a cellular network. The headset may include various transducers (e.g., microphone, speaker) that enable the user to engage in the call. The user may also several other mobile or compact apparatus, either wearable or implanted into the human body. By way of example, the user may be wearing a watch 110 that transmits time and other information (which may include audio or speech) from a user interface to the computer 108, and/or a sensor 112 which monitors vital body parameters (e.g., a biometric sensor, a heart rate monitor, a pedometer, and EKG device, etc.). The sensor 112 transmits information (which may include audio or speech) from the body of the person to the computer 108 where the information may be forwarded to a medical facility (e.g., hospital, clinic, etc) through a backhaul connection to the Internet or other remote network.

The various audio and speech processing techniques presented throughout this disclosure may be used in wireless apparatus supporting any suitable radio technology or wireless protocol. By way of example, the wireless apparatus shown in FIG. 1 may be part of a personal area network configured to support Ultra-Wideband (UWB) technology. UWB is a common technology for high speed short range communications and is defined as any radio technology having a spectrum that occupies a bandwidth greater than 20 percent of the center frequency, or a bandwidth of at least 500 MHz. Alternatively, the wireless apparatus may be configured to support Bluetooth or some other suitable wireless protocol for personal area network. The cellular phone 104 may be configured to support a connection to a wide area network using Code Division Multiple Access (CDMA) 2000, Evolution-Data Optimized (EV-DO), Ultra Mobile Broadband (UMB), Universal Terrestrial Radio Access Network (UTRAN), Long Term Evolution (LTE), Wideband CDMA (W-CDMA), High Speed Downlink Packet Data (HSDPA), Time Division-Code Division Multiple Access (TD-CDMA), Time Division-Synchronous Code Division Multiple Access (TD-SCDMA), or some other suitable telecommunications standard. The computer 102 may be configured to also support a connection to one or more of these networks, and/or a connection to an IEEE 802.11 network. Alternatively, or in addition to, the computer 102 may be configured to support a wired connection using standard twisted pair, cable modem, Digital Subscriber Line (DSL), fiber optics, Ethernet, HomeRF, or any other suitable wired access protocol.

Figure 2:
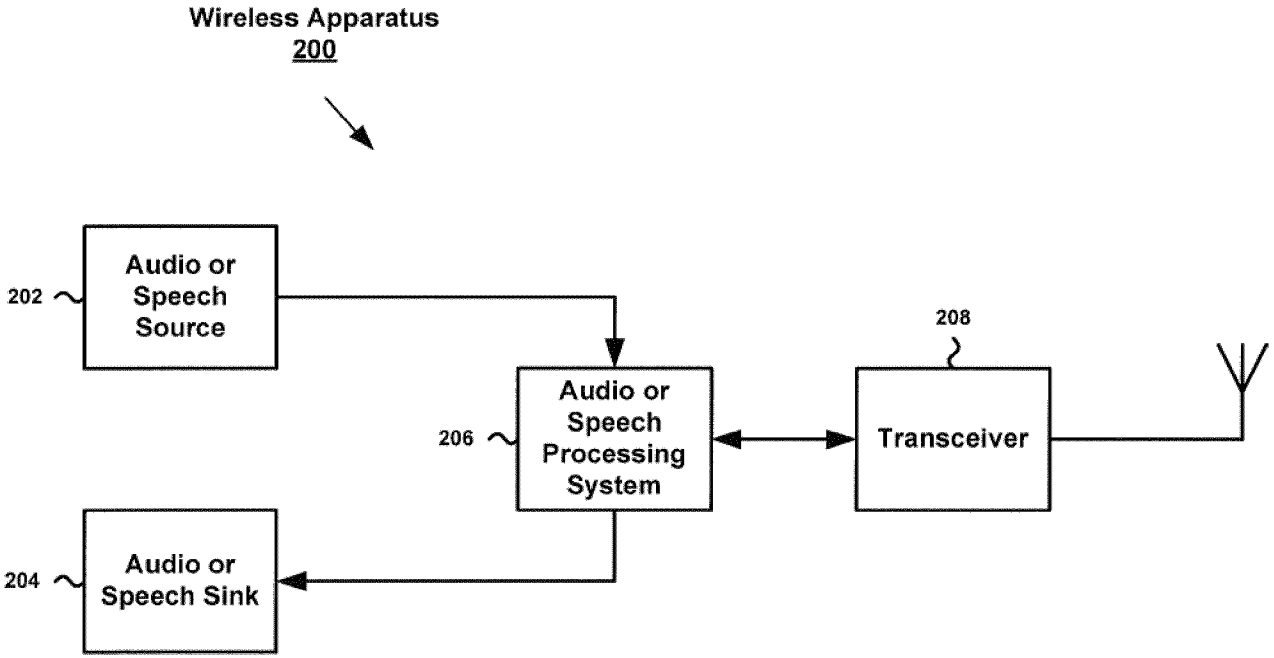
FIG. 2 is a conceptual block diagram illustrating an apparatus for wireless communications.

FIG. 2 is a conceptual block diagram illustrating an apparatus for wireless communications. The apparatus 200 is shown with an audio or speech source 202, audio or speech sink 204, an audio or speech processing system 206, and a transceiver 208. In this aspect, the apparatus 200 is a two-way communication apparatus having a processing system 206 that functions as an audio or speech codec. The term "audio or speech processing system" is intended to mean a processing system capable of processing audio only, a processing system cable of processing speech only, or a processing system capable of processing both audio and speech. The various concepts presented throughout this disclosure are intended to apply to each of these processing systems.

The audio or speech source 202 represents conceptually any suitable source of audio or speech. By way of example, the audio or speech source 202 may represent various applications running in the apparatus 200 that retrieve compressed audio files (e.g., MP3 files) from memory and decompresses them using an appropriate file format decoding scheme. Alternatively, the audio or speech source 202 may represent a microphone and associated circuitry to process analog speech signal from the user of the apparatus into digital samples. The audio or speech source 202 could instead represent a transceiver or modem capable of accessing audio or speech from a wired or wireless backhaul. As those skilled in the art will readily appreciate, the manner in which the audio or speech source 202 is implemented will depend on the particular design and application of the transmitting apparatus 200.

The audio or speech sink 204 represents conceptually any suitable entity capable of receiving audio or speech. By way of example, the audio or speech source 204 may represent various applications running in the apparatus 200 that compress audio files using an appropriate file format encoding scheme (e.g., MP3 files) for storing in memory. Alternatively, the audio or speech sink 204 may represent a speaker and associated circuitry to provide audio or speech to the user of the apparatus 200. The audio or speech sink 204 could instead represent a transceiver or modem capable of transmitting audio or speech over a wired or wireless backhaul. As those skilled in the art will readily appreciate, the manner in which the audio or speech source 204 is implemented will depend on the particular design and application of the transmitting apparatus 200.

The audio or speech processing system 206 may implement a compression algorithm to encode and decode audio and speech. The compression algorithm may use transforms to convert between sampled audio and speech and a transform domain, typically the frequency domain. In the transform domain, the component frequencies are allocated bits according to their audibility. In this example, the processing system 206 may take advantage of the frame-by-frame processing involved in any transform domain approach to ensure optimal bit allocation for each frame. Although the bit allocations are specialized to each frame, the processing system 206 may be configured to ensure a constant bit rate across frames. This approach enables an optimal bit allocation strategy over the entire signal of interest which, in turn ensures optimal compression ratio for a given quality requirement, and optimal quality for a given compression ratio.

The transceiver 208 may be used to perform various physical (PHY) and Medium Access Control (MAC) layer functions in connection with the transmission of audio or speech across a wireless medium. The PHY layer functions may include several signal processing functions such as forward error correction (e.g., Turbo coding/decoding), digital modulation/demodulation (e.g., FSK, PSK, QAM, etc.), and analog modulation/demodulating of an RF carrier. The MAC layer functions may include managing the audio or speech content that is sent across the PHY layer so that several apparatus can share access to the wireless medium.

Figure 3:
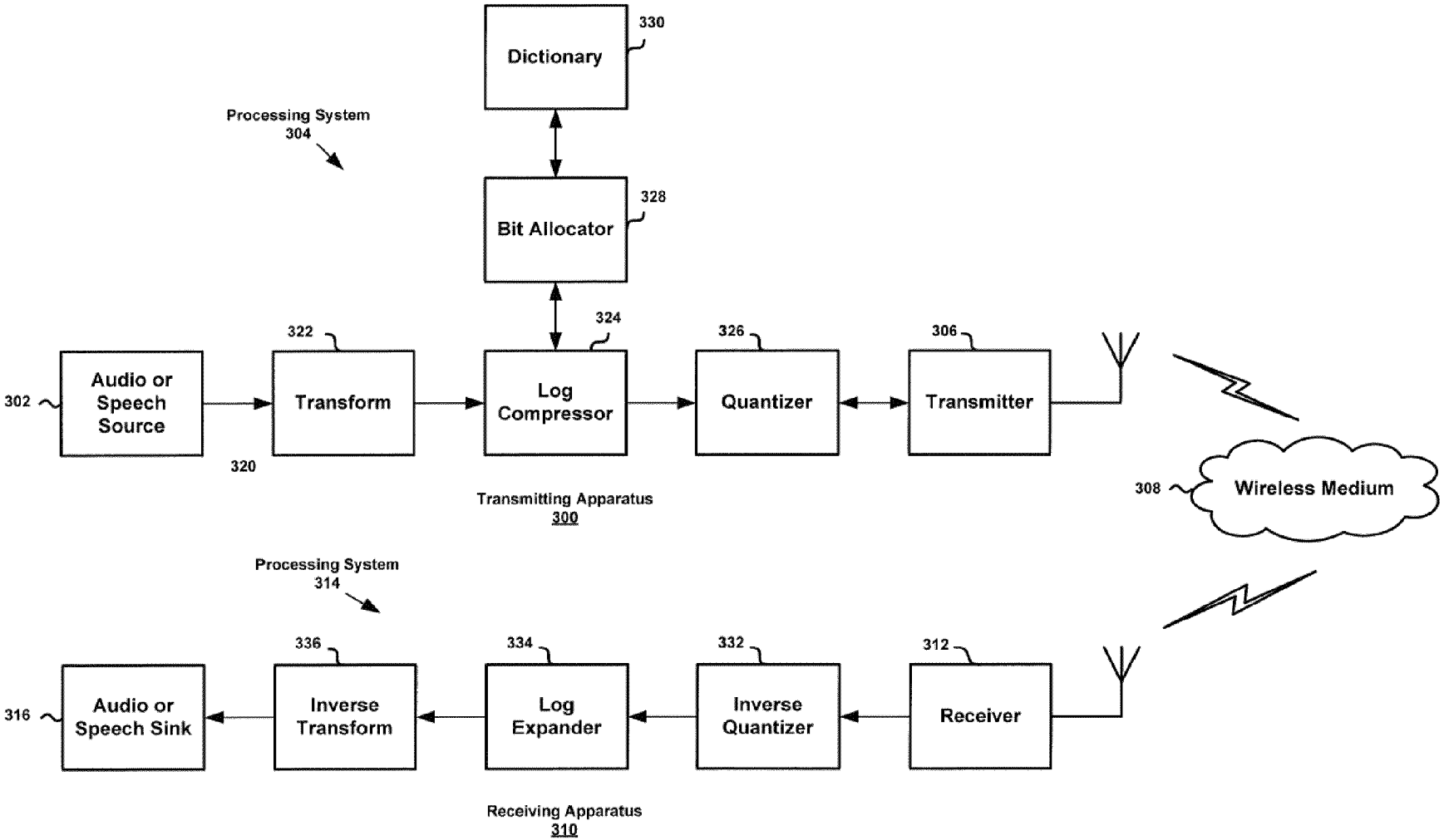
FIG. 3 is a conceptual block diagram illustrating an example of an audio or speech processing system in the context of a transmitting apparatus in communication with a receiving apparatus.

FIG. 3 is a conceptual block diagram illustrating a more detailed example of an audio or speech processing system in the context of a transmitting apparatus in communication with a receiving apparatus. In the discussion that follows, the terms transmitting apparatus and receiving apparatus are used for the purpose of illustration and does not imply that such apparatus are incapable of performing both transmit and receive functions.

The transmitting apparatus 300 is shown with an audio or speech source 302, an audio or speech processing system 304, and a transmitter 306. The receiving apparatus 310 is shown with a receiver 312, an audio or speech processing system 314, and an audio or speech sink 316. The audio or speech source 302 and transmitter 306 in the transmitting apparatus 300 and the receiver 312 and the audio or speech sink 316 in the receiving apparatus 310 function in the same way as described earlier in connection with FIG. 2, and therefore, will not be described any further. The audio and speech processing systems 304, 314 will be presented in the context of transform domain log companding, however, as those skilled in the art will readily appreciate, these concepts may be extended to any domain where audio or speech compression involves frame-by-frame processing.

The audio or speech processing system 304 in the transmitting apparatus 300 includes a transform 322. The transform 322 may be a Discrete Cosine Transform (DCT) that converts audio or speech from the source 302 into a series of transform coefficients in the frequency domain. The output of the transform 322 is processed in sets of coefficients called frames. Each frame consists of N transform coefficients. The N transform coefficients in each frame are logarithmically compressed by a log compressor 324 before being input to a quantizer 326. The quantizer 326 quantizes the logarithmically compressed N transform coefficients before being provided to the transmitter 306 and modulated onto an RF carrier for transmission over a wireless medium 308.

A bit allocator 328 is configured to control the level of quantization applied by the quantizer 326 to the logarithmically compressed N transform coefficients. In at least one configuration of the processing system 304, the bit allocator 328 is configured to distribute a fixed number of bits B across the logarithmically compressed N coefficients for each frame. This may be achieved by computing a metric M' based on at least one of $M_i$ (i=1, 2, . . . , N) correlated to the energy of each coefficient in a frame. By way of example, M can simply be the square of the coefficient's amplitude. M' can also be computed over more than one frame and be the variance of each transform bin. A theoretically optimal bit allocation vector v of length N is computed by distributing the B bits in proportion to M'. This is then mapped to one of the K available vectors in a dictionary V of size (K×N) 330 that is "closest" to the ideal vector v. The K available vectors may be represented by $d_k$.

The dictionary 330 contains a set of vectors, $d_k$, each of which is N elements long. Each element in a vector $d_k$ represents a possible bit-allocation for a corresponding coefficient in a frame. The sum of elements of each vector $d_k$ in the dictionary 330 is equal to B. This ensures a constant bit rate across frames and across a collection of frames (e.g., MAC packets). For each frame, once a vector $d_k$ is selected by the bit allocator 328, it may be provided to the quantizer 326 to quantize the logarithmically compressed N transform coefficients of the said frame.

For a dictionary V comprising of K vectors, ceiling($\log_2$(K)) bits are required to index the elements of the dictionary. Once a vector $d_k$ is selected by the bit allocator 328 for a frame, a corresponding index identifying the selected vector $d_k$ may be transmitted along with the frame to the receiving apparatus 310 for decoding the frame. The index may be sent via out-of-band signaling, side channel, interleaved within the frame, or by some other suitable means. The number of vectors in the dictionary 330 may generally be a function of the bandwidth limitations for sending the index over the wireless medium 308.

Various methods may be used to create the dictionary 330. By way of example, a statistical metric, $S_i$, may be computed for each bin across multiple frames of a training database. The statistical metric $S_i$ can then be used in techniques like k-means clustering to create the elements of the dictionary. Each vector in the dictionary may be constructed to ensure that the sum of its elements equal B. Additionally, each vector may be constrained to comprise of positive whole numbers.

At the receiving apparatus 310, each frame and its corresponding index are recovered from the RF carrier by the receiver 312 and provided to the audio or speech processing system 314. The processing system 314 includes an inverse quantizer 332 which uses the index to expand the coefficients in the frame. The frame of expanded coefficients may then be provided to a log expander 334, which performs an inverse log function, before being provided to an inverse transform 336 to convert the coefficients in the frame back to digital samples in the time domain. The time domain samples may be provided to the audio or speech sink 316 for further processing.

The audio and speech processing techniques could be extended to processing multiple frames at a time using their joint-statistics to decide on the ideal bit-allocation vector for that set of frames. This would reduce the amount of information required to be sent over the wireless medium by using the same bit allocation vector across multiple consecutive frames. This would be suitable for signals like speech or audio where there is considerable correlation between frames.

In cases where a single bit allocation vector is required due to architectural and/or capacity constraints, the audio or speech processing system may be specialized to a one-element dictionary that does not require any additional information to be transmitted with the frames across the wireless medium.

The various concepts presented throughout this disclosure, provides a method for specializing compression factors to the frame level. This approach essentially maintains a constant bit rate while at the same time ensuring that each speech or audio frame is optimally compressed. This approach also elements the need for a variable bit rate pipe for transport, which makes the design of MAC/PHY more complex, generally associated with dynamic bit allocation schemes.

In addition, these concepts are agnostic to the signal structure and does not require any psycho-acoustic or a-priori knowledge of the signal's structure in either the temporal or transform domain. Bit allocation decisions are optimally made using the energy of individual components in each frame.

The "audio or speech processing system" shall be construed broadly to mean any apparatus, component, device, circuit, block, unit, module, element, or any other entity, whether implemented as hardware, software, or a combinations of both, that performs the various functions presented throughout this disclosure. Whether such functionality is implemented as hardware or software depends upon the particular application and design constraints imposed on the overall system. Skilled artisans may implement the described functionality in varying ways for each particular application.

The processing system may be implemented with one or more processors. The one or more processors, or any of them, may be dedicated hardware or a hardware platform for executing software on a computer-readable medium. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise. The one or more processor may include, by way of example, any combination of microprocessors, microcontrollers, digital signal processors (DSPs), field programmable gate arrays (FPGAs), programmable logic devices (PLDs), state machines, gated logic, discrete hardware circuits, and other suitable processors configured to perform the various functionalities described throughout this disclosure. The computer-readable medium may include, by way of example, a magnetic storage device (e.g., hard disk, floppy disk, magnetic strip), an optical disk (e.g., compact disk (CD), digital versatile disk (DVD)), a smart card, a flash memory device (e.g., card, stick, key drive), random access memory (RAM), read only memory (ROM), programmable ROM (PROM), erasable PROM (EPROM), electrically erasable PROM (EEPROM), a register, a removable disk, a carrier wave, a transmission line, or any other suitable medium for storing or transmitting software. The computer-readable medium may be resident in the processing system, external to the processing system, or distributed across multiple entities including the processing system. The computer-readable medium may be embodied in a computer-program product. By way of example, a computer-program product may include a computer-readable medium in packaging materials. The computer-readable medium may also be used to implement the dictionary.

Figure 4:
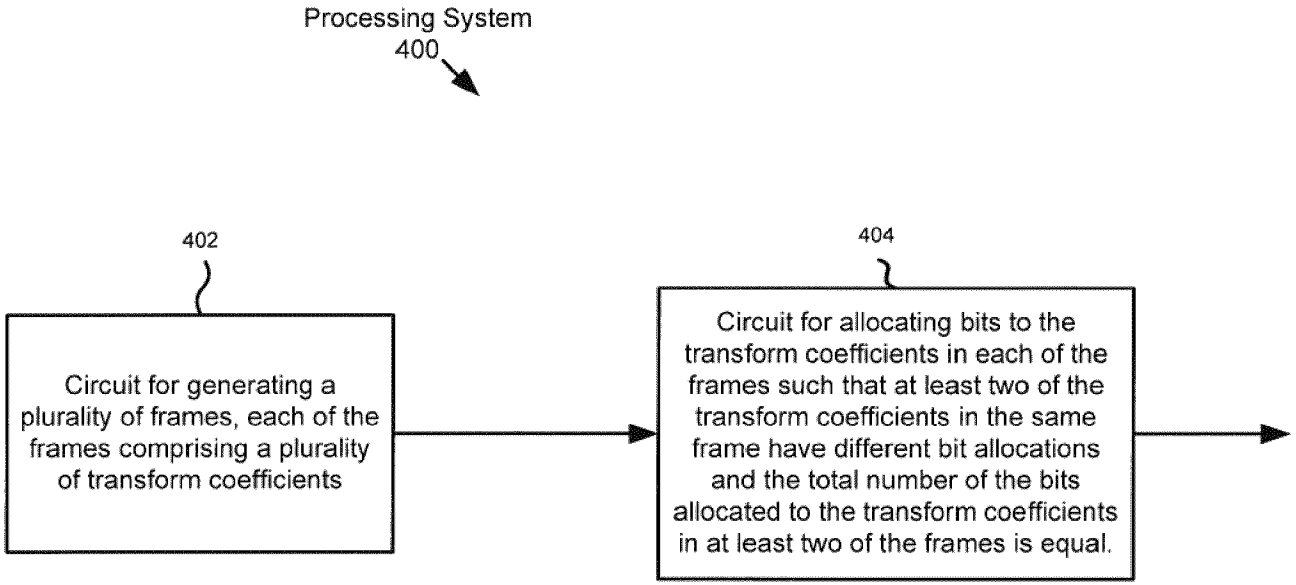
FIG. 4 is a functional block diagram illustrating an example of an audio or speech processing system.

The processing system, or any part of the processing system, may provide the means for performing the functions recited herein. Turning to FIG. 4, the processing system 400 may provide a circuit 402 for generating a plurality of frames, each of the frames comprising a plurality of transform coefficients, and a circuit 404 for allocating bits to the transform coefficients in each of the frames such that at least two of the transform coefficients in the same frame have different bit allocations and the total number of the bits allocated to the transform coefficients in at least two of the frames is equal. Alternatively, the code on the computer-readable medium may provide the means for performing the functions recited herein.

Figure 5:
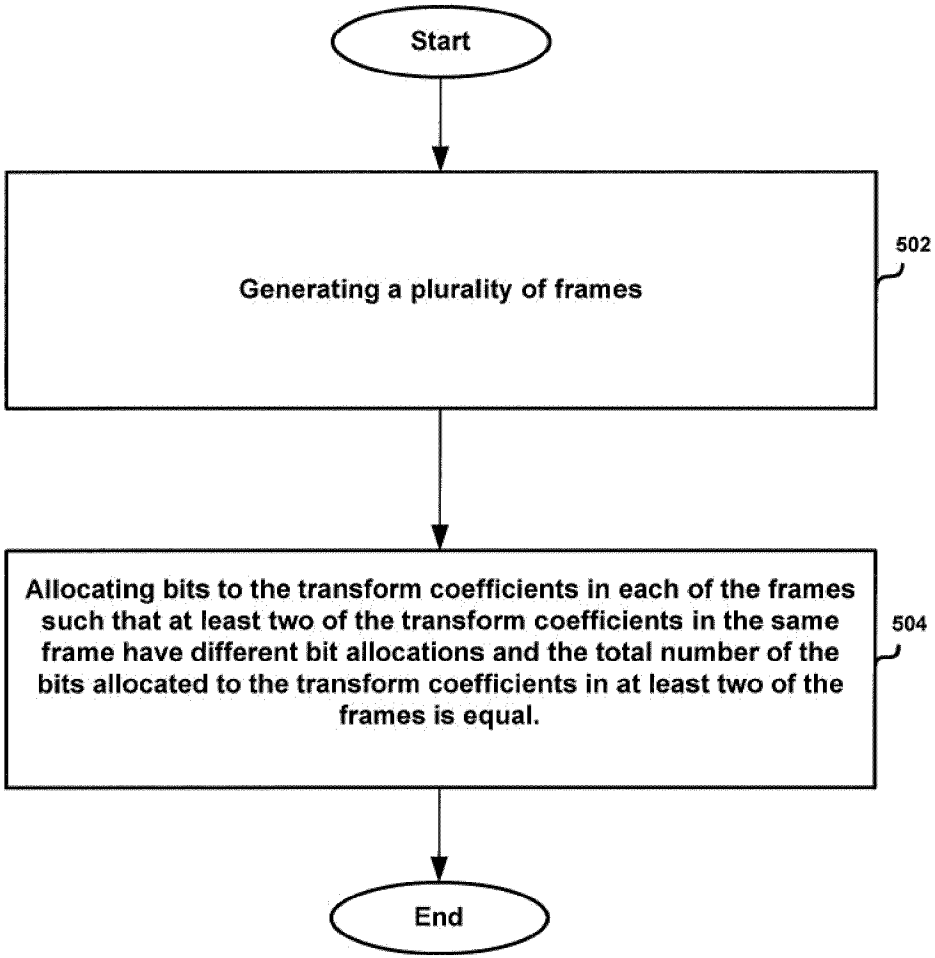
FIG. 5 is a flow chart illustrating an example of a method of algorithm for processing audio or speech.

FIG. 5 is a flow chart illustrating an example of a method or algorithm for processing audio or speech. The method, process, or algorithm may be implemented by the audio or speech processing system or by some other suitable means. Turning to FIG. 5, a plurality of frames are generated in step 502. Each of the frames comprises a plurality of transform coefficients. In step 504, bits are allocated to the transform coefficients in each of the frames such that at least two of the transform coefficients in the same frame have different bit allocations and the total number of the bits allocated to the transform coefficients in at least two of the frames is equal. The allocation of may be based on a dictionary comprising a plurality of bit allocation vectors. Each of the bit allocation vectors may include a plurality of elements, with each of the elements representing a possible bit allocation for a corresponding one of the transform coefficients in any one of the frames. The sum of the elements in each of the bit allocation vectors equals a fixed number.

Figure 6:
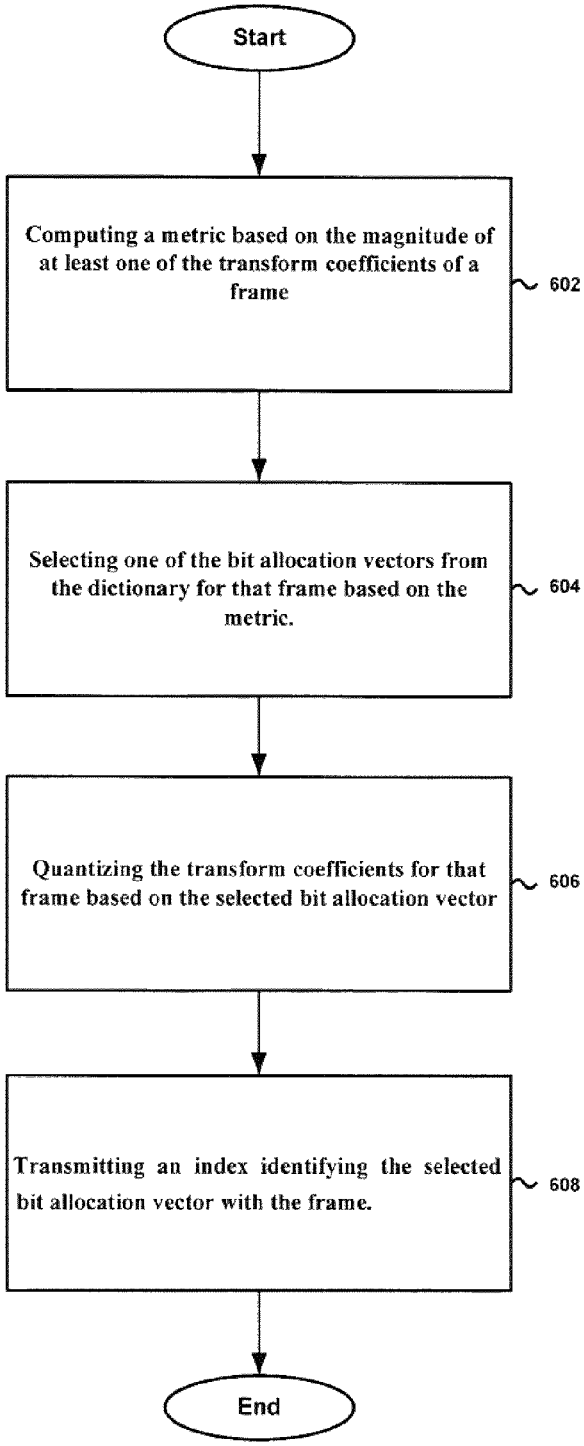
FIG. 6 is a flow chart illustrating an example of the process of allocating bits to the transform coefficients in the method or algorithm of FIG. 5.

FIG. 6 is a flow chart illustrating an example of the process of allocating bits to the transform coefficients in each of the frames. In step 602, a metric based on the magnitude of at least one of the transform coefficients for a frame is computed. In step 604, one of the bit allocation vectors is selected from the dictionary for that frame based on the metric. In step 606, the transform coefficients for that frame are quantized based on the selected bit allocation vector. In step 608, an index identifying the selected bit allocation vector transmitted with the frame. The index may be transmitted within the frame or independent of the frame.

Figure 7:
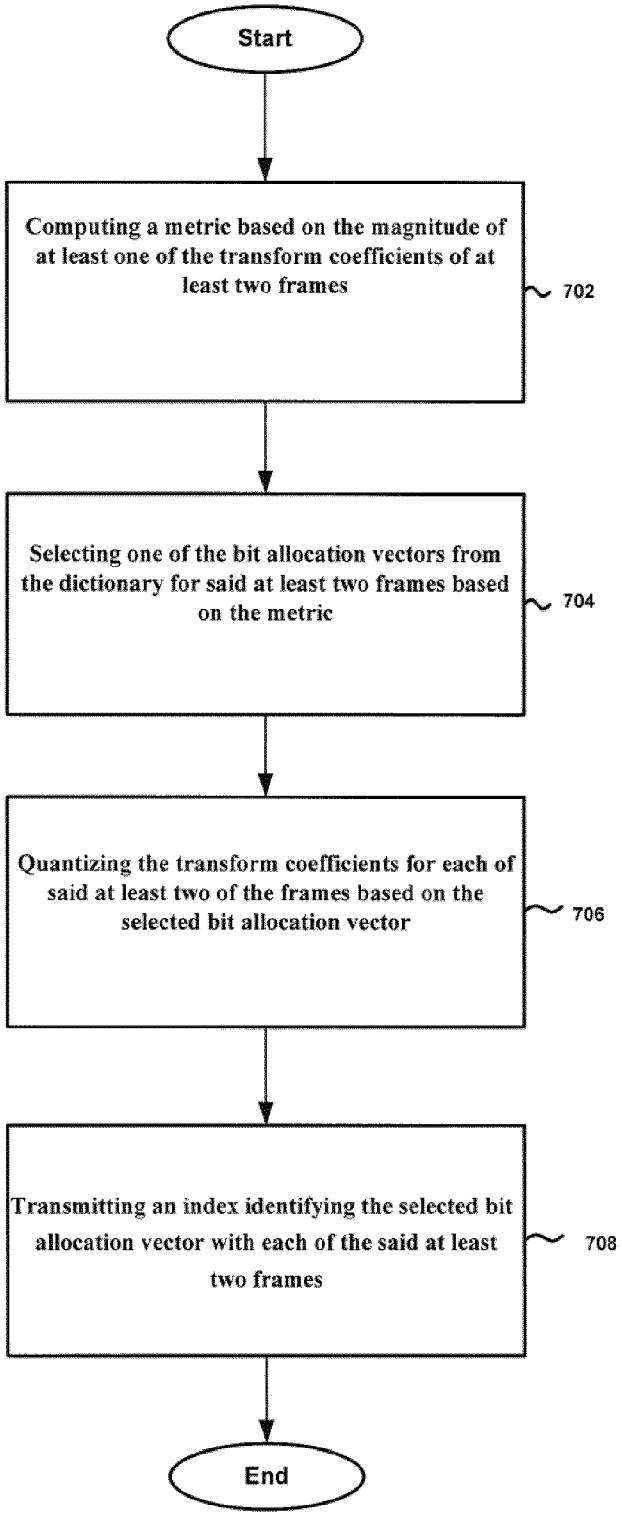
FIG. 7 is a flow chart illustrating an alternative example of a process for allocating bits to transform coefficients in the method of algorithm of FIG. 5.

FIG. 7 is a flow chart illustrating an alternative example of a process for allocating bits to transform coefficient in each of the frames. In step 702, a metric is computed based on the magnitude of at least one of the transform coefficients of at least two frames. In step 704, one of the bit allocation vectors from the dictionary is selected for said at least two frames based on the metric. In step 706, the transform coefficients for each of said at least two of the frames are quantized based on the selected bit allocation vector. In step 708, an index identifying the selected bit allocation vector is transmitted with each of said at least two frames.

It is understood that the specific order or hierarchy of steps in the processes disclosed is an illustration of exemplary approaches. Based upon design preferences, it is understood that the specific order or hierarchy of steps in the processes may be rearranged. The accompanying method claims present elements of the various steps in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A method of audio or speech processing, comprising:

generating, by an apparatus, a plurality of frames, each of the frames comprising a plurality of transform coefficients;

allocating bits, by the apparatus, to the transform coefficients in each of the frames such that at least two of the transform coefficients in the same frame have different bit allocations and the total number of the bits allocated to the transform coefficients in at least two of the frames is equal, wherein the allocation of the bits for each of the frames is based on a selected one of a plurality of predefined bit allocation vectors in a dictionary, the selection of the selected predefined bit allocation vector being based on respective amplitudes of the transform coefficients, wherein the allocation comprises selecting one of the bit allocation vectors from the dictionary for each of the frames, wherein each of the bit allocation vectors is identified by an index; and transmitting each of the frames with the index for the bit allocation vector selected for that frame, wherein the index for each of the frames is transmitted within that frame.

2. The method of claim 1 wherein each of the bit allocation vectors comprises a plurality of elements, each of the elements representing a possible bit allocation for a corresponding one of the transform coefficients in any one of the frames, wherein the sum of the elements of all bit allocation vectors in the dictionary equals a fixed number.

3. The method of claim 1 wherein the allocation comprises quantizing the transform coefficients for each of the frames based on the selected bit allocation vector for that frame.

4. The method of claim 1 wherein the selection comprises computing a metric based on the respective amplitudes of the transform coefficients for that frame, and selecting the bit allocation vector based on the metric.

5. The method of claim 1 wherein the index for each of the frames is transmitted independent of the transmission of that frame.

6. The method of claim 1 wherein the allocation comprises selecting one of the bit allocation vectors from the dictionary for at least two of the frames.

7. The method of claim 6 wherein the selection comprises computing a metric based on respective amplitudes of the transform coefficients for said at least two of the frames, and selecting the bit allocation vector based on the metric.

8. The method of claim 6 wherein the allocation further comprises quantizing the transform coefficients for each of said at least two of the frames based on the selected bit allocation vector.

9. The method of claim 6 further comprising transmitting said at least two of the frames with the index for the bit allocation vector.

10. The method of claim 1, wherein the predefined bit allocation vectors each allocate the same number of bits.

11. An apparatus for audio or speech processing, comprising:

a processing system configured to:

generate a plurality of frames, each of the frames comprising a plurality of transform coefficients; and allocate bits to the transform coefficients in each of the frames such that at least two of the transform coefficients in the same frame have different bit allocations and the total number of the bits allocated to the transform coefficients in at least two of the frames is equal, wherein the processing system further comprises a dictionary having a plurality of predefined bit allocation vectors, wherein the allocation of the bits for each of the frames is based on a selected one of the predefined bit allocation vectors, the selection of the selected predefined bit allocation vector being based on respective amplitudes of the transform coefficients;

wherein the processing system is further configured to allocate bits by selecting one of the bit allocation vectors from the dictionary for each of the frames, and wherein each of the bit allocation vectors is identified by an index; and a transmitter configured to transmit each of the frames with the index for the bit allocation vector selected for that frame, wherein the transmitter is configured to transmit the index for each of the frames within that frame.

12. The apparatus of claim 11 wherein each of the bit allocation vectors comprises a plurality of elements, each of the elements representing a possible bit allocation for a corresponding one of the transform coefficients in any one of the frames, wherein the sum of the elements of all the bit allocation vectors in the dictionary equals a fixed number.

13. The apparatus of claim 11 wherein the processing system is further configured to allocate bits by quantizing the transform coefficients for each of the frames based on the selected bit allocation vector for that frame.

14. The apparatus of claim 11 wherein the processing system is further configured to select one of the bit allocation vectors by computing a metric based on the respective amplitudes of the transform coefficients for that frame, and selecting the bit allocation vector based on the metric.

15. The apparatus of claim 11 wherein the transmitter is configured to transmit the index for each of the frames independent of the transmission of that frame.

16. The apparatus of claim 11 wherein the processing system is further configured to allocate bits by selecting one of the bit allocation vectors from the dictionary for at least two of the frames.

17. The apparatus of claim 16 wherein the processing system is further configured to select the bit allocation vector by computing a metric based on respective amplitudes of the transform coefficients for said at least two of the frames, and selecting the bit allocation vector based on the metric.

18. The apparatus of claim 16 wherein the processing system is further configured to allocate bits by quantizing the transform coefficients for each of said at least two of the frames based on the selected bit allocation vector.

19. The apparatus of claim 16 wherein the transmitter is configured to transmit said at least two of the frames with the index for the bit allocation vector selected for said at least two of the frames.

20. An apparatus for audio or speech processing, comprising:

means for generating a plurality of frames, each of the frames comprising a plurality of transform coefficients;

means for allocating bits to the transform coefficients in each of the frames such that at least two of the transform coefficients in the same frame have different bit allocations and the total number of the bits allocated to the transform coefficients in at least two of the frames is equal, wherein the allocation of the bits for each of the frames is based on a selected one of a plurality of predefined bit allocation vectors in a dictionary, the selection of the selected predefined bit allocation vector being based on respective amplitudes of the transform coefficients, wherein the means for allocating bits comprises means for selecting one of the bit allocation vectors from the dictionary for each of the frames, and wherein each of the bit allocation vectors is identified by an index; and means for transmitting each of the frames with the index for the bit allocation vector selected for that frame, wherein the means for transmitting comprises means for transmitting the index for each of the frames within that frame.

21. The apparatus of claim 20 wherein each of the bit allocation vectors comprises a plurality of elements, each of the elements representing a possible bit allocation for a corresponding one of the transform coefficients in any one of the frames, wherein the sum of the elements of all the bit allocation vectors in the dictionary equals a fixed number.

22. The apparatus of claim 20 wherein the means for allocation comprises means for quantizing the transform coefficients for each of the frames based on the selected bit allocation vector for that frame.

23. The apparatus of claim 20 wherein the means for selecting comprises means for computing a metric based on the respective amplitudes of the transform coefficients for that frame, and means for selecting the bit allocation vector based on the metric.

24. The apparatus of claim 20 wherein the means for transmitting comprises means for transmitting the index for each of the frames independent of the transmission of that frame.

25. The apparatus of claim 20, wherein the means for allocating bits further comprises means for selecting one of the bit allocation vectors from the dictionary for at least two of the frames.

26. The apparatus of claim 25 wherein the means for selecting one of the bit allocation vectors comprises means for computing a metric based on respective amplitudes of the transform coefficients for said at least two of the frames, and means for selecting the bit allocation vector based on the metric.

27. The apparatus of claim 25 wherein the means for allocating bits further comprises means for quantizing the transform coefficients for each of said at least two of the frames based on the selected bit allocation vector.

28. The apparatus of claim 25 further comprising means for transmitting said at least two of the frames with the index for the bit allocation vector selected for said at least two of the frames.

29. A computer-program product for processing audio or speech, comprising:

computer-readable storage device encoded with codes executable by a processor to:

generate a plurality of frames, each of the frames comprising a plurality of transform coefficients; and allocate bits to the transform coefficients in each of the frames such that at least two of the transform coefficients in the same frame have different bit allocations and the total number of the bits allocated to the transform coefficients in at least two of the frames is equal, wherein the allocation of the bits for each of the frames is based on a selected one of a plurality of predefined bit allocation vectors in a dictionary, the selection of the selected predefined bit allocation vector being based on respective amplitudes of the transform coefficients, wherein the allocation comprises selecting one of the bit allocation vectors from the dictionary for each of the frames, wherein each of the bit allocation vectors is identified by an index; and transmit each of the frames with the index for the bit allocation vector selected for that frame, wherein the index for each of the frames is transmitted within that frame.

30. A headset, comprising:

a transducer;

a processing system configured to:

generate a plurality of frames from audio or speech output from the transducer, each of the frames comprising a plurality of transform coefficients; and allocate bits to the transform coefficients in each of the frames such that at least two of the transform coefficients in the same frame have different bit allocations and the total number of the bits allocated to the transform coefficients in at least two of the frames is equal, wherein the allocation of the bits for each of the frames is based on a selected one of a plurality of predefined bit allocation vectors in a dictionary, the selection of the selected predefined bit allocation vector being based on respective amplitudes of the transform coefficients, wherein the processing system is further configured to allocate bits by selecting one of the bit allocation vectors from the dictionary for each of the frames, and wherein each of the bit allocation vectors is identified by an index; and a transmitter configured to transmit each of the frames with the index for the bit allocation vector selected for that frame, wherein the transmitter is configured to transmit the index for each of the frames within that frame.

31. A watch comprising:

a user interface;

a processing system configured to:

generate a plurality of frames from audio or speech output from the user interface, each of the frames comprising a plurality of transform coefficients; and allocate bits to the transform coefficients in each of the frames such that at least two of the transform coefficients in the same frame have different bit allocations and the total number of the bits allocated to the transform coefficients in at least two of the frames is equal, wherein the allocation of the bits for each of the frames is based on a selected one of a plurality of predefined bit allocation vectors in a dictionary, the selection of the selected predefined bit allocation vector being based on respective amplitudes of the transform coefficients, wherein the processing system is further configured to allocate bits by selecting one of the bit allocation vectors from the dictionary for each of the frames, and wherein each of the bit allocation vectors is identified by an index; and a transmitter configured to transmit each of the frames with the index for the bit allocation vector selected for that frame, wherein the transmitter is configured to transmit the index for each of the frames within that frame.

32. A sensing apparatus, comprising:

a sensor;

a processing system configured to:

generate a plurality of frames from audio or speech output from the sensor, each of the frames comprising a plurality of transform coefficients; and allocate bits to the transform coefficients in each of the frames such that at least two of the transform coefficients in the same frame have different bit allocations and the total number of the bits allocated to the transform coefficients in at least two of the frames is equal, wherein the allocation of the bits for each of the frames is based on a selected one of a plurality of predefined bit allocation vectors in a dictionary, the selection of the selected predefined bit allocation vector being based on respective amplitudes of the transform coefficients, wherein the processing system is further configured to allocate bits by selecting one of the bit allocation vectors from the dictionary for each of the frames, and wherein each of the bit allocation vectors is identified by an index; and a transmitter configured to transmit each of the frames with the index for the bit allocation vector selected for that frame, wherein the transmitter is configured to transmit the index for each of the frames within that frame.

33. A method of audio or speech processing, comprising:

generating, by an apparatus, a plurality of frames, each of the frames comprising a plurality of transform coefficients;

allocating bits, by the apparatus, to the transform coefficients in each of the frames such that at least two of the transform coefficients in the same frame have different bit allocations and the total number of the bits allocated to the transform coefficients in at least two of the frames is equal, wherein the allocation of the bits for each of the frames is based on a selected one of a plurality of predefined bit allocation vectors in a dictionary, wherein the allocation comprises selecting one of the bit allocation vectors from the dictionary for each of the frames, wherein each of the bit allocation vectors is identified by an index; and transmitting each of the frames with the index for the bit allocation vector selected for that frame, and wherein the index for each of the frames is transmitted within that frame.

34. An apparatus for audio or speech processing, comprising:

a processing system configured to:

generate a plurality of frames, each of the frames comprising a plurality of transform coefficients; and allocate bits to the transform coefficients in each of the frames such that at least two of the transform coefficients in the same frame have different bit allocations and the total number of the bits allocated to the transform coefficients in at least two of the frames is equal, wherein the processing system further comprises a dictionary having a plurality of predefined bit allocation vectors, and wherein the allocation of the bits for each of the frames is based on a selected one of the predefined bit allocation vectors, wherein the processing system is further configured to allocate bits by selecting one of the bit allocation vectors from the dictionary for each of the frames, and wherein each of the bit allocation vectors is identified by an index; and a transmitter configured to transmit each of the frames with the index for the bit allocation vector selected for that frame, wherein the transmitter is configured to transmit the index for each of the frames within that frame.

35. An apparatus for audio or speech processing, comprising:

means for generating a plurality of frames, each of the frames comprising a plurality of transform coefficients;

means for allocating bits to the transform coefficients in each of the frames such that at least two of the transform coefficients in the same frame have different bit allocations and the total number of the bits allocated to the transform coefficients in at least two of the frames is equal, wherein the allocation of the bits for each of the frames is based on a selected one of a plurality of predefined bit allocation vectors in a dictionary, wherein the means for allocating bits comprises means for selecting one of the bit allocation vectors from the dictionary for each of the frames, and wherein each of the bit allocation vectors is identified by an index; and means for transmitting each of the frames with the index for the bit allocation vector selected for that frame, wherein the means for transmitting comprises means for transmitting the index for each of the frames within that frame.

* * * * *